US009296968B1

(12) United States Patent
Mayfield

(10) Patent No.: US 9,296,968 B1
(45) **Date of Patent: *Mar. 29, 2016**

(54) FIRE KINDLER

(71) Applicant: Robert Nicholas Mayfield, Williams, AZ (US)

(72) Inventor: Robert Nicholas Mayfield, Williams, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/121,675

(22) Filed: Oct. 6, 2014

(51) Int. Cl.
*C10L 5/36* (2006.01)
*C10L 11/00* (2006.01)
*C10L 11/06* (2006.01)

(52) U.S. Cl.
CPC . *C10L 11/06* (2013.01); *C10L 5/36* (2013.01); *C10L 2230/06* (2013.01); *C10L 2230/14* (2013.01)

(58) Field of Classification Search
CPC ..... C10L 5/36; C10L 5/365; C10L 11/00; C10L 11/06
USPC ..... 44/530, 532, 533, 535
See application file for complete search history.

(56) References Cited

U.S. PATENT DOCUMENTS

| | | | | |
|---|---|---|---|---|
| 57,890 | A * | 9/1866 | Gilson | C10L 5/36 44/491 |
| 182,087 | A | 9/1876 | Tylee | |
| 201,184 | A | 3/1878 | Lewis | |
| 211,085 | A | 1/1879 | Burnett | |
| 213,768 | A | 4/1879 | McShane | |
| 286,103 | A | 10/1883 | Wood et al. | |
| 585,001 | A | 6/1897 | McDonald | |
| 829,072 | A | 8/1906 | Hill | |
| 2,007,694 | A | 7/1935 | Rutherford | |
| 3,346,352 | A | 10/1967 | McCoy | |
| 4,060,396 | A | 11/1977 | Burton | |
| 4,116,645 | A | 9/1978 | Dalzell | |
| 4,243,394 | A * | 1/1981 | Kincaid | B65D 85/62 44/520 |
| 4,460,377 | A | 7/1984 | Kalil | |
| 4,781,128 | A | 11/1988 | Salner | |
| 4,818,249 | A * | 4/1989 | Barrett, Jr. | C10L 5/44 428/905 |
| 4,952,217 | A * | 8/1990 | Porter | C10L 5/44 44/522 |
| 4,994,091 | A * | 2/1991 | Dougherty | C10L 11/04 44/532 |
| 5,186,721 | A | 2/1993 | Campana | |
| 6,379,405 | B1 | 4/2002 | Reiger et al. | |
| 2002/0129808 | A1* | 9/2002 | Manner | C10L 5/40 126/45 |
| 2005/0023714 | A1* | 2/2005 | Manner | B01J 20/24 264/115 |
| 2005/0246946 | A1* | 11/2005 | Paplinski | A47J 37/079 44/544 |
| 2008/0134572 | A1* | 6/2008 | Cui | C10L 5/36 44/542 |
| 2009/0307968 | A1* | 12/2009 | Parker | B27B 1/005 44/535 |
| 2011/0126452 | A1* | 6/2011 | Blackmore | C10L 5/36 44/522 |
| 2011/0192078 | A1* | 8/2011 | Malone | C10L 5/36 44/532 |

FOREIGN PATENT DOCUMENTS

| | | | |
|---|---|---|---|
| GB | 402838 | A | 12/1933 |
| GB | 839602 | A | 6/1960 |
| WO | WO0018855 | A1 | 4/2000 |

* cited by examiner

*Primary Examiner* — Nina Bhat

(57) ABSTRACT

A fire kindler (FIGS. 1,2 and 3) comprised of a geometrically shaped slab configuration of combustible material which operates in vertical positioning to present common lower crest (20) and a structural continuation of symmetric communal acclivity with surfaces (16),(10), and (12) which all culminate at top surface (14). Body of fire kindler (8) having apertures, (18A),(18B), and (18C) of generally horizontal and variable plurality, passing completely therethrough. Other embodiments utilizing lessor, greater, or no apertures at all.

8 Claims, 1 Drawing Sheet

FIRE KINDLER

CROSS-REFERENCE TO RELATED APPLICATIONS

This application is a CIP of patent application Ser. No. 13/506,841, filed 2012 May 17 by the present inventor, which is incorporated by reference and claims priority of PPA Ser. No. 61/571,258, filed 2011 Jun. 22.

BACKGROUND

Prior Art

The following is a list of relevant prior art:

| U.S. Patents | | |
|---|---|---|
| 182,087 | September 1876 | Tylee |
| 201,184 | March 1878 | Lewis |
| 211,085 | January 1879 | Burnett |
| 213,768 | April 1879 | McShane |
| 286,103 | October 1883 | Wood et. al |
| 585,001 | June 1897 | McDonald |
| 829,072 | August 1906 | Hill |
| 2,007,694 | July 1935 | Rutherford |
| 3,346,352 | October 1967 | McCoy |
| 4,060,396(A) | November 1977 | Burton |
| 4,116,645 | September 1978 | Dalzell |
| 4,460,377 | July 1984 | Kalil |
| 4,781,128 | November 1988 | Salner |
| 4,952,217 | August 1990 | Porter |
| 5,186,721 | February 1993 | Campana |
| 6,379,405 | April 2002 | Reiger |

| Foreign Patent Documents | | |
|---|---|---|
| 402838(A) | December 1933 | GB |
| 839602(A) | June 1960 | GB |
| 0018855(A1) | May 2000 | WO |

Those familiar with any attempt to ignite a campfire are aware that certain outdoor conditions may often exist to hinder the effort. Damp wood and breezes are common outdoor conditions. To combat such conditions campers will often employ rather bulky and heavy fire kindlers. Such kindlers are awkward to carry and therefore, not conducive for use in hiking situations. So, they are usually used in close areas from the users' storage or vehicle.

Several types of bulky kindlers have been proposed and apertures are commonly considered with them. The aperture considerations of heretofore known kindlers have been meant to permit some passage of air to facilitate self-combustion so to achieve a prolonged burn duration and assist in the distribution of numerous flames across fire kindler surfaces. For example, U.S. Pat. No. 829,072 to Hill (1906) discloses such an intention. Also, U.S. Pat. No. 2,007,694 to Rutherford (1935) discloses air passage to aid combustion and flame spreading so to completely consume to ash. While U.S. Pat. No. 4,781,128 to Salner (1988) discloses an intention to maintain a long duration of combustion.

Many kindlers use waxes to sustain their bulk and flames. For example, U.S. Pat. No. 3,346,352 to McCoy (1967) discloses that the wax is intended to spread the flames over the surface of the article. Such of this type are commonly found in local markets today and many share in awkward bulk. If reduced to a portable size, these types become relatively less effective than their previous bulk.

Although functional, the heretofore known fire kindlers have numerous disadvantages:

a) Those with bulk, heaviness, and awkward shapes are not comfortably portable. Therefore, they are not conducive to hiking, biking, hunting and other active sports including survival type outings.

b) Their bulkiness can be detrimental to their operation as well. Bulky shapes produce a wide dispersal of potential heat. The heat potential is portioned out along the expanse of the extensive surfaces, resulting in numerous scattered flames. These random flames delivering less than their heat potential.

c) For success, the dispersed heat delivery of these fire kindlers relies upon various attempts to prolong the burn durations of self-combustion. The intention being, to last long enough to hopefully ignite a campfire.

d) In outdoor conditions kindlers with dispersed heat delivery and those with reduced sources are more easily extinguished. They can also be unsuccessful when the breeze repeatedly pushes their aimless heat away, or, when the intended firewood becomes or remains damp.

e) Kindlers which have stick shapes often become starved of combustible air as they are inadvertently sandwiched in stacked logs or crowded between pieces of intended firewood. Also, they quickly deteriorate during operation and collapse upon themselves or then fall out of effective range. Thus, they can be wasteful and less successful.

f) Waxy type kindlers allow for surprising messes from disturbances in transport. Becoming softer they become weak and then misshapen or even separated.

g) In operation waxy kindlers can have their heat delivery become even more dispersed. Often they fall apart during, operation. Thus, spreading themselves thinner. Also, these waxes are most often of a petroleum base which is now considered environmentally undesirable.

h) Some kindlers purposely offer little, weak flames that will demand complicated work from the user.

i) Kindlers which possess very miniscule properties, such as those with strikers and flints, rely entirely upon the tedious expert work of the user for any success. Also, if comprised of moving parts these types may malfunction.

j) Even when used indoors damp wood may still be found among the intended firewood, making the attempt with the heretofore known kindlers less successful.

SUMMARY

In accordance with one embodiment a fire kindler has clean, comfortable, protective portability. Having ease of ignition and use, and a hot and steady solitary flame. Being comprised of an appropriately sized slab of combustible material having vertical attitude in operation and a sturdy geometrical shape of proportional thickness. One embodiment, enough to possess sufficient fuel and support a variable plurality of generally horizontal apertures, therethrough.

Advantages

Accordingly several advantages of one or more aspects of my fire kindler are as follows:

a) Desirable size, weight, and shape can be produced and packaged in comfortable and protective rigid pocket-tins.

b) Potential heat is drawn together into a solitary flame. A unified flame is developed which delivers the heat more consistently to a piece of firewood placed deliberately above it. There is less dispersal of heat. There is increased delivery of potential heat. A hot-spot is, thereby, created on the intended firewood. Whereby dampness evaporates.

c) Heat is directed to and remains more frequently upon the localized area. Thus, increasing a rate of entropy and increasing speed of ignition. Spreading flames and prolonging duration of combustion is not necessary.

d) Outdoor conditions such as breezes and dampness of intended firewood are combated by a more steady confluent solitary flame.

e) A firm, compact shape of 100% natural resinous wood having sturdy proportions and specific intention, prescribes for a deliberate placement of the article.

f) The natural firmness of the combustible article and its rigid packaging, insure and protect a reliable operation of the kindler.

g) Reliable operation and the firmness of the 100% natural wood article assures for a more consistent, undispersed, and stationary delivery of potential heat by the solitary flame to the developing hot-spot. Local dampness quickly evaporates.

h) The reliable operation produces the solitary flame comprised of enhanced heat output and steadiness. Thus, the user is given extensive assistance.

i) The extensive assistance of the reliable operation supplies most of the work needed to establish a successful campfire ignition. Even if the firewood is damp. The kindler has no moving parts.

j) Being well suited for outdoor conditions, the kindler becomes more effective when used in indoor fireplaces. Even with damp wood.

Other advantages of one or more aspects of one embodiment will be apparent from a consideration of the drawings and ensuing description.

REFERENCE NUMERALS

Figure 1:
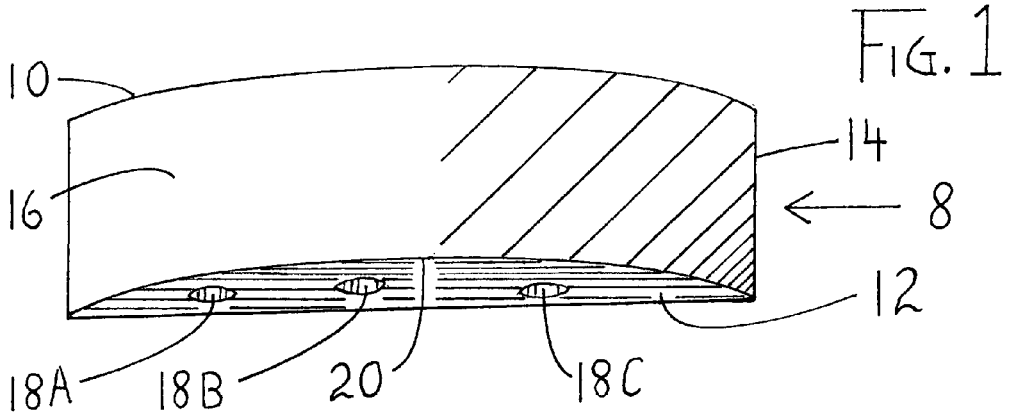
FIG. 1 is a bottom perspective view of one embodiment.

08 body of fire kindler
10 side surface
12 opposite side surface
14 top surface
16 bottom surface
18A cylindrical wall of aperture
18B cylindrical wall of aperture
18C cylindrical wall of aperture
20 common lower crest

DETAILED DESCRIPTION

Figure 2:
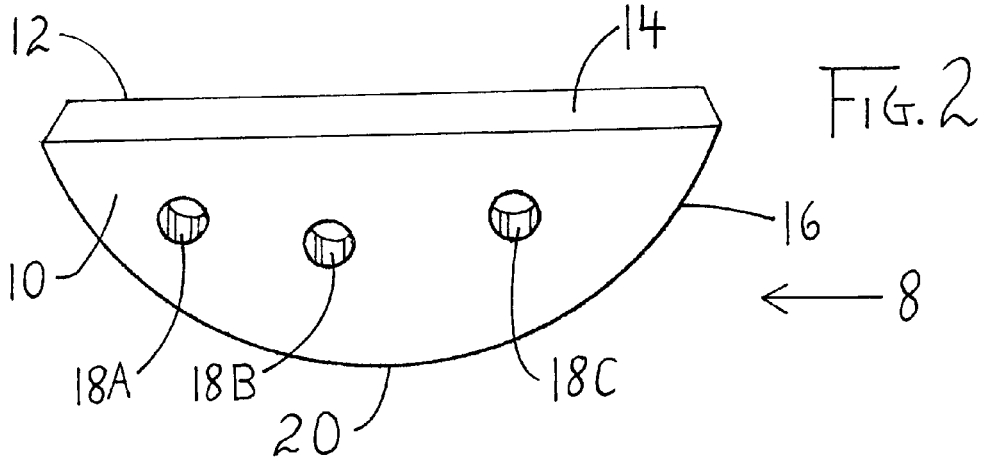
FIG. 2 is a side perspective view of one embodiment.
Figure 3:
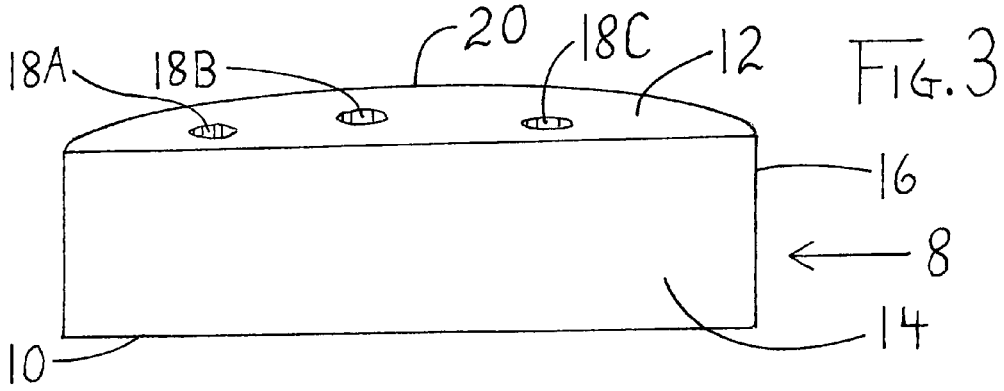
FIG. 3 is a top perspective view of one embodiment.

FIGS. 1, 2, and 3

One embodiment of a fire kindler is illustrated in FIG. 1, FIG. 2, and FIG. 3. Body of fire kindler 8 of FIGS. 1,2, and 3 is a geometrically shaped slab configuration which, in one embodiment, is cut from an initial plate of combustible material derived from abundantly available and nonendangered resinous pine trees. The initial plate is generally seven and one half centimeters in length and width with a two and one half centimeter thickness. The initial plate is crosscut, so that two equal, halved, slabs are created which, thereby, then exhibit one prominent crest, each. Thus, either slab presents, when applied in vertical attitude, a bottom surface 16 of FIGS. 1,2, and 3 which has a common lower crest 20 of FIGS. 1,2, and 3. Crest 20 made common by its communication with side surface 10 of FIGS. 1,2, and 3 and with opposite side surface 12 of FIGS. 1,2, and 3. Crest 20 also correlating with a symmetric and communal acclivity in accordance with side surfaces 10 and 12. In further accordance, surfaces 16, 10, and 12 all terminating at vertical height in communication with a cornice that is top surface 14 of FIGS. 1,2, and 3.

The initial plate may be derived by sawing transversely through tree limbs or tree trunks so to have manageable logs. Band saws or hole saws may then produce geometrically shaped blocks of the appropriate dimensions from these sources. Now these block shapes may then be transversely cut to produce the appropriate thickness for further processing and for the equal halving, as has been described.

The body of fire kindler 8 has a variable plurality of generally horizontal apertures which extend completely therethrough. An arrangement of which is shown in FIGS. 1,2, and 3, of one embodiment, at a sufficient plurality of three cylindrically walled apertures, respectively, 18A,18B, and 18C. Each aperture is an exact duplicate of each other aperture. Therefore, a description of one aperture is exactly applicable to another of the variable plurality of apertures that exist in one embodiment.

It is therefore described that a boring tool having dimensions suitable to produce the cylindrical wall of the aperture 18A is mechanically sent completely through body of fire kindler 8 at a generally perpendicular attitude relative to side surfaces 10 and 12. Upon removal of the boring tool, the entire cylindrical wall of the aperture 18A will be completed. And so shall it be done with the apertures 18B and 18C of one embodiment.

Aperture introduction will be considerate of placement, proportion, and plurality relative to a physical stability of any fire kindler body. Consideration will also be applied so to retain sufficient amounts of the 100% natural resinous and combustible material that, in one embodiment, is indeed the body of fire kindler 8. In other embodiments there may be no apertures at all due to these considerations. In the absence of apertures the fire kindler will be suitable for use in more benign environments such as indoor fireplaces and woodstoves.

Operation

In operation, of one embodiment, the common lower crest 20 should be substantially exposed and elevated at a height of approximately two and one half centimeters above any base surface. This may be achieved by deliberately placing body of fire kindler 8 in a vertical attitude between two parallel pieces of firewood, so that bottom surface 16 is facing downward with the recommended elevation below it. The far ends of top surface 14 are in communication with, and are, each, extending perpendicularly from an opposite face of the parallel firewood pieces. So, to be bridge-like.

A firewood surface that is intended to be ignited should be deliberately positioned and supported, so to be adjustable, at approximately fifteen centimeters above the cornice of the kindler. This may be easily achieved by stacking a scaffold of horizontal firewood pieces closely up and around the kindler. Place two parallel pieces per horizontal level, with each level criss-crossing the other. Then, at the level of recommended height, horizontal firewood may be placed so to intentionally cross into a predicted path of a forthcoming solitary flame. In this way the kindlers flame tip may rise to stand and be locally applied immediately below the intended firewood surface. The height of that surface being easily adjusted, if necessary, from one scaffold level to another.

Once prepared, a single match, or such, is applied along bottom surface 16 at common lower crest 20 of the body of fire kindler 8. The resinous material of the kindler and its symmetric communal acclivity quickly and co-operatively establish combustion. The body of fire kindler 8 becomes engulfed.

Now, the symmetrical communal acclivity of surfaces 16, 10, and 12 direct and support an unobstructed confluency of combustion. A symmetry of combustion, enhances balance and solidarity in a unified flame establishing itself above top surface 14. Thus, producing a more steady and solitary flame.

The apertures of one embodiment are comprised of the cylindrical walls of the apertures, respectively, 18A, 18B, and 18C. Whereby, during combustion, additional evolving combustible gases are extracted and exposed to exterior excess air along side surfaces 10 and 12. Thus, contributing to the production of heat while progressing to top surface 14. Thereby, in one embodiment, co-operatively establishing a hotter and more confluent solitary flame.

During peak operation the hotter and more steady solitary flame remains more constantly and returns more frequently, in outdoor conditions, to the localized area on the intended firewood. Whereby, a higher rate of entropy occurs and the ease at which the firewood ignites is, therefore, increased. Even if the firewood is damp. Even if the breezes blow.

CONCLUSION, RAMIFICATIONS, AND SCOPE

Thus the reader will see that at least one embodiment of the fire kindler provides a device which functions in a manner to produce a utilitarian result. One which enables a wide range of users to carry, comfortably in their pocket, a more reliable option for igniting a campfire. One which supplies an enhanced delivery of work needed for successful ignition.

Although the fire kindler is particularly well adapted for outdoor conditions, it is considered that it can also be of use in benign conditions, such as indoor fireplaces and woodstoves.

While the above description contains many specificities, these should not be construed as limitations on the scope, but rather as an exemplification of one embodiment thereof.

Many other variations are contemplated. For example:

I can see reducing proportions for deliberate use in air-tight woodstoves;

I can see enlarging proportions for deliberate use in oversized, usually commercial, fireplaces;

I can see routing grooves upon bottom surface 16, so to introduce a notch, or notches, for improved ease of ignition;

I can see beveling the edges of surfaces 10,12,14, and 16;

I can see applying a generally 30 degree chamfer to apertures upon side surfaces 10 and 12;

I can see administering alternative embodiments into different geometrically shaped slabs, such as, triangular and elliptical;

I can see administering alternative embodiments into different types of combustible materials;

I can see administering alternative embodiments from castable molds comprising preformed apertures, if any;

I can see offering packaging conducive to multiple unit sale, especially for indoor fireplaces;

Accordingly, the scope of the fire kindler should be determined not by the embodiment illustrated, but by the appended claims and their legal equivalents.

I claim:

1. A fire kindler comprising a geometrically shaped slab configuration of combustible material having vertical application wherein a variable plurality of cylindrical apertures pass completely therethrough in a horizontal direction, so to produce a rectangular confluency of combustion for a steadier and hotter flame for igniting solid fuels placed above it.

2. A fire kindler according to claim 1 wherein said geometrically shaped slab configuration having vertical application is comprised of a semi-circular shaped plate which vertically presents a common lower crest having symmetric communal acclivity terminating in a rectangular cornice.

3. A fire kindler according to claim 2 wherein said common lower crest is comprised of the lowest portion of the fire kindler body where a bottom surface and two symmetric vertical side surfaces are conjoined, whereby ignition is facilitated and the vertical application is constituted.

4. A fire kindler according to claim 2 wherein said symmetric communal acclivity terminating in a rectangular cornice comprises an external conformation of the vertical plate which continues from said lower crest whereby the communal bottom surface and the symmetric vertical side surfaces provide swift upward drafting and directing of combustion so to extend a confluent flame from around the rectangular cornice top, whereby the confluency and the steadier rectangular flame are constituted.

5. A fire kindler according to claim 1 wherein said combustible material is 100% natural Pine.

6. A fire kindler according to claim 1 wherein said variable plurality includes two horizontal cylindrical apertures.

7. A fire kindler according to claim 1 wherein said horizontal direction is a 90 degree direction relative to the vertical side surfaces of said slab.

8. A fire kindler according to claim 1 wherein said (8) having horizontal apertures, (18A), (18B), and (18C) passing completely therethrough and which have a variable plurality including no apertures at all.

* * * * *